US005468604A

United States Patent [19]

Zengerle et al.

[11] Patent Number: 5,468,604

[45] Date of Patent: Nov. 21, 1995

[54] PHOTOGRAPHIC DISPERSION

[75] Inventors: Paul L. Zengerle; David D. Miller; Thomas H. Whitesides; John B. Rieger, all of Rochester; Vincent J. Flow, III, Kendall; Walter H. Isaac, Penfield, all of N.Y.

[73] Assignee: Eastman Kodak Company, Rochester, N.Y.

[21] Appl. No.: 978,104

[22] Filed: Nov. 18, 1992

[51] Int. Cl.[6] ..... G03C 1/005; G03C 1/494

[52] U.S. Cl. ..... 430/631; 430/546; 430/551; 430/372

[58] Field of Search ..... 430/546, 631, 430/372, 551

[56] References Cited

U.S. PATENT DOCUMENTS

| | | | |
|---|---|---|---|
| 2,728,659 | 12/1955 | Loria et al. | 430/551 |
| 2,787,544 | 4/1957 | Godowsky et al. | 430/545 |
| 2,801,170 | 7/1957 | Vittum et al. | 430/545 |
| 3,004,896 | 10/1961 | Heller et al. | 430/59 |
| 3,253,921 | 5/1966 | Sawdey | 430/507 |
| 3,700,453 | 10/1972 | Knechel | 430/505 |
| 3,982,944 | 9/1976 | Ohi et al. | 430/644 |
| 4,181,527 | 1/1980 | Toda et al. | 430/543 |
| 4,193,802 | 3/1980 | Mukunoki et al. | 430/139 |
| 4,323,633 | 4/1982 | Beretta | 430/17 |
| 4,366,236 | 12/1982 | Takahashi | 430/505 |
| 4,407,940 | 10/1983 | Nakamura et al. | 430/546 |
| 4,419,440 | 12/1983 | Kuhnert et al. | 430/546 |
| 4,419,441 | 12/1983 | Nittel et al. | 430/377 |
| 4,430,421 | 2/1984 | van de Sande et al. | 430/546 |
| 4,576,908 | 3/1986 | Vallarino | 430/512 |
| 4,614,709 | 9/1986 | Sasaki et al. | 430/546 |
| 4,770,983 | 9/1988 | Ogawa et al. | 430/505 |
| 4,791,050 | 12/1988 | Ogawa et al. | 430/506 |
| 4,945,034 | 7/1990 | Tamji et al. | 430/546 |
| 4,954,432 | 9/1990 | Nishijima | 430/546 |
| 4,983,507 | 1/1991 | Takahashi et al. | 430/551 |
| 5,006,456 | 4/1991 | Morigaki et al. | 430/372 |
| 5,008,170 | 4/1991 | Karakida et al. | 430/65 |
| 5,008,179 | 4/1991 | Chari et al. | 430/546 |
| 5,082,764 | 1/1992 | Takahashi et al. | 430/546 |

FOREIGN PATENT DOCUMENTS

| | | |
|---|---|---|
| 0363820 | 4/1990 | European Pat. Off. . |
| 0536663 | 10/1992 | European Pat. Off. . |
| 2538889 | 3/1976 | Germany . |
| 5147665 | 3/1973 | Japan . |
| 51-48467 | 2/1976 | Japan . |
| 02004239 | 1/1990 | Japan . |
| 1077426 | 7/1967 | United Kingdom . |
| 2039068 | 7/1980 | United Kingdom . |
| 9218901 | 10/1992 | WIPO . |
| 93/03420 | 2/1993 | WIPO . |

OTHER PUBLICATIONS

*Colloid & Polymer Sci.*, vol. 257, pp. 636–644 (1979), "The effect of long–chain alkanes on the stability of oil–in–water emulsions. The significance of ostwald ripening", R. Buscall, S. S. Davis, and D. C. Potts.

*Journal of Colloid and Interface Science*, vol. 80, No. 2, (Apr. 1981), pp. 508–511, "Ostwald Ripening and the Stability of Emulsion Systems: An Explanation for the Effect of an Added Third Component", S. S. Davis, H. P. Round, and T. S. Purewal.

*Colloids and Surfaces*, vol. 24(1987), pp. 19–32, "Ostwald Ripening in Two–Component Disperse Phase Systems: Application to Emulsion Stability", A. S. Kabal'Nov, A. V. Pertzov and E. D. Shchukin.

*Research Disclosure*, 308119, Dec. 1989.

*Primary Examiner*—Charles L. Bowers, Jr.
*Assistant Examiner*—Geraldine Letscher
*Attorney, Agent, or Firm*—Andrew J. Anderson

[57] ABSTRACT

A stabilized photographic dispersion is prepared by adding a hydrophobic, photographically inert compound which has a $\log P_{(calc)}$ greater than about 9 and does not solidify or gel the dispersed phase to a photographic dispersion comprising an aqueous medium and a dispersed liquid organic phase comprising a photographically useful compound which is (i) soluble in organic solvents, (ii) substantially insoluble in water, and (iii) subject to particle growth of at least 10% of its initial particle size when maintained in said dispersion in the absence of the added photographically inert compound.

28 Claims, 8 Drawing Sheets

PHOTOGRAPHIC DISPERSION

FIELD OF THE INVENTION

This invention relates to a method of stabilizing a photographic dispersion, the resulting stabilized dispersion and photographic elements prepared therefrom.

BACKGROUND OF THE INVENTION

In the manufacture of photographic dispersions, photographically useful compounds are dispersed in an aqueous medium containing a hydrophilic colloid, such as gelatin. The photographically useful compound may be a liquid which may be dispersed directly into the aqueous medium or it may be a solid or liquid predissolved in an organic solvent. Typically, the photographically useful compound is dissolved in a permanent organic solvent, optionally with the use of an auxiliary solvent which assists dissolution of the photographically useful compound in the permanent solvent. The photographically useful compound or solution thereof is mixed under high shear or turbulence together with the aqueous medium, which may also contain a surfactant, in order to break the organic phase into submicron particles dispersed in a continuous aqueous phase. The auxiliary solvent, if present, is then removed by evaporation, washing or dialysis. The resulting dispersion comprises an aqueous medium containing a dispersed liquid organic phase comprising particles containing the photographically useful compound.

The resulting dispersion can be coated onto a support or incorporated into a silver halide emulsion or other photographic composition which is then coated onto a support. Generally a photographic element comprises a plurality of layers, at least one of which comprises a silver halide emulsion, coated onto a support. During, or just prior to, the coating step the dispersion may be heated to about 45° C. and maintained at that temperature for up to 24 hours. It has been noted that in certain instances the dispersed particles containing the photographically useful compound can undesirably grow in the dispersion. This particle growth can cause the photographically useful material to become less effective for its intended purpose. For example, a dispersion containing relatively large particles of an ultra violet (UV) absorber may absorb less UV radiation (i.e., have a lower covering power) than a comparable smaller particle UV absorber dispersion. Similarly, dispersions containing an oxidized developer scavenger of undesirable large particle size may result in the dispersion scattering more light which may lead to granularity increases, sharpness losses, and/or density losses in the coated photographic element. In addition, if the particle growth is severe enough for extremely large particles (greater than 5 μm in diameter) to be formed, the particles themselves may be visible in magnified prints or projections representing a physical defect in the coated photographic product.

Other photographically useful compounds which may exhibit undesirable particle growth include, for example, organic liquids which improve the scratch-resistance or pressure sensitivity of photographic materials during handling and mechanical transfer operations, or modify the reactivity of compounds of the layers, etc; optical brighteners; incorporated developers; anti-fogging agents; and the like.

An attempt to slow the particle growth in photographic dispersions is disclosed in U.S. Pat. No. 4,181,527 to Toda et al. Toda et al disclose that incorporation of organic solvent gelling agents, such as N-acylamino acid amides, N-acylamino acid amine salts, and dehydrated condensates of benzaldehydes and sorbitol or xylitol, into a photographic dispersion solidifies or "gels" the oil phase of the dispersion, thereby inhibiting particle growth. While this method does slow particle growth, the resulting viscosity increase of the dispersed phase containing the photographically useful compound can result in undesired decreases in performance such as reactivity or lubricity.

PROBLEM TO BE SOLVED BY THE INVENTION

A problem solved by our invention is the inhibition of particle growth in a photographic dispersion comprising a liquid organic phase dispersed in an aqueous medium without significantly increasing the viscosity of the dispersed organic phase.

SUMMARY OF THE INVENTION

We have found that certain compounds which do not solidify or gel the dispersed liquid organic phase can effectively inhibit undesired particle growth in photographic dispersions subject to such particle growth. The compounds are hydrophobic, photographically inert compounds that have a $\log P_{(calc)}$ of at least about 9, where $\log P_{(calc)}$ is the logarithm of the value of the octanol/water partition coefficient (P) of the compound calculated using MedChem, version 3.54, a software package available from the Medicinal Chemistry Project, Pomona College, Claremont, California. $\mathrm{Log}P_{(calc)}$ is a parameter which is highly correlated with measured water solubility for compounds spanning a wide range of hydrophobicity. Compounds having a $\log P_{(calc)}$ greater than about 9 are so highly hydrophobic that it is difficult to measure their water solubility using standard techniques. $\mathrm{Log}P_{(calc)}$ is a useful means to characterize their hydrophobicity.

One aspect of this invention comprises a method for stabilizing a photographic dispersion comprising an aqueous medium and a dispersed liquid organic phase comprising a photographically useful compound which is (i) soluble in organic solvents, (ii) substantially insoluble in water, and (iii) subject to particle growth of at least 10% of its initial particle size when maintained in said dispersion, which method comprises adding to said dispersed phase a hydrophobic, photographically inert compound which has a $\log P_{(calc)}$ greater than about 9 and does not solidify or gel the dispersed phase, said photographically inert compound being added in an amount sufficient to inhibit particle growth of said photographically useful compound in said dispersion.

Another aspect of this invention comprises a photographic dispersion comprising an aqueous medium and a dispersed liquid organic phase comprising:

(a) a photographically useful compound which is (i) soluble in organic solvents, (ii) substantially insoluble in water, and (iii) subject to particle growth of at least 10% of its initial particle size when maintained in said dispersion; and (b) in an amount sufficient to inhibit particle growth of said photographically useful compound, a hydrophobic, photographically inert compound which has a $\log P_{(calc)}$ greater than about 9 and which does not solidify or gel the dispersed phase.

A further aspect of this invention comprises a photographic element comprising a support having coated thereon a layer prepared from said dispersion. Preferably the photographic element comprises a plurality of layers, at least one of which is prepared from a dispersion of this invention and at least one of which comprises an aqueous emulsion containing silver halide grains.

There are various mechanisms which may be responsible for the growth of dispersed liquid particles comprising a photographically useful compound. Such mechanisms include, for example, flocculation, coalescence, ripening, etc. While not wishing to be bound by any theory, our discovery that the incorporation of a highly hydrophobic compound into the dispersed liquid phase comprising the photographically useful compound inhibits particle growth leads us to conclude that Ostwald ripening is primarily responsible for the particle growth of the photographically useful compound. Our conclusion is based on reports in the non-photographic literature that the addition of highly hydrophobic compounds to the organic phase of dispersions inhibits Ostwald ripening of the particles. See Colloid & Polymer Sci. 257, 636–644 (1979), Journal of Colloid and Interface Science, Vol 80, No. 2, 1981, pp 508–511 and Colloid and Surfaces, 24 (1987) pp 19–32. These articles are not concerned with photographically useful compounds and do not suggest that particle growth of such compounds is due to Ostwald ripening.

It is to be understood that mechanisms other than Ostwald ripening may in fact be responsible for the undesired particle growth of photographically useful compounds in the dispersed phase in photographic dispersions and that the effectiveness of the incorporation of hydrophobic photographically inert compounds into the dispersed phase may be due to an as yet undiscovered mechanism.

DESCRIPTION OF THE INVENTION

Figure 1:
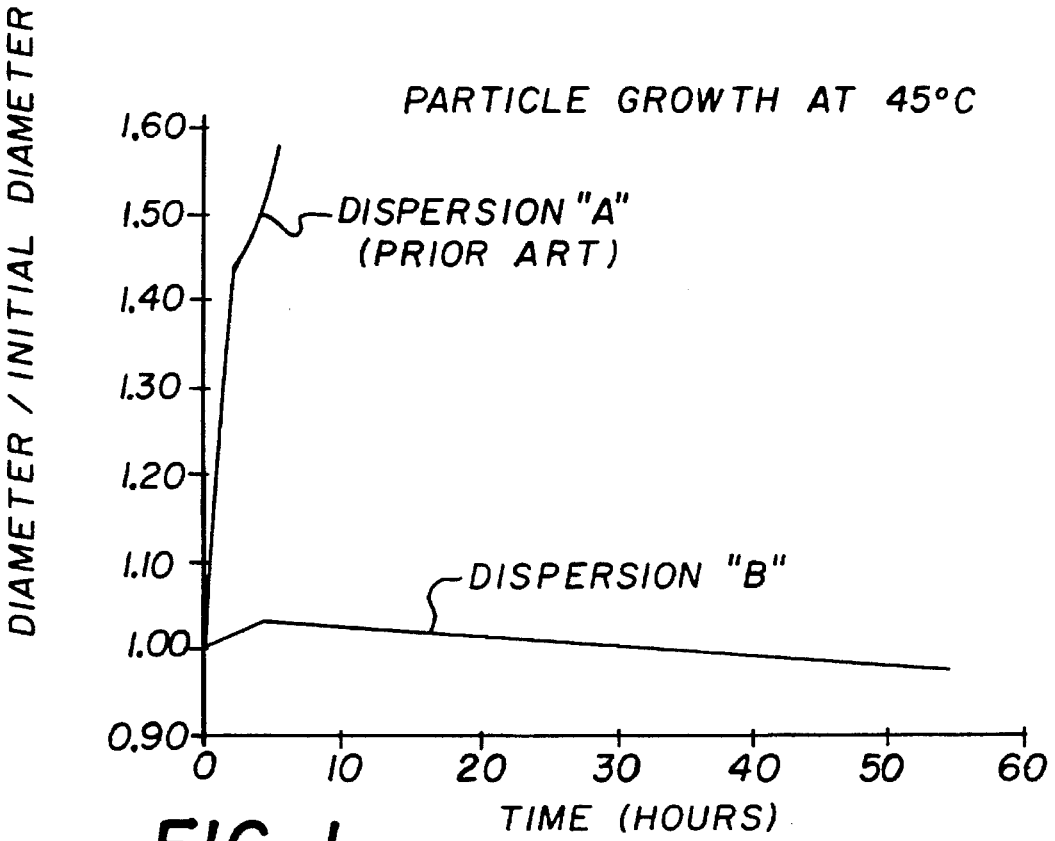
FIGS. 1 through 13 are graphic representations of the particle growth/particle growth inhibition of photographic dispersions set forth in the examples.

The photographic dispersion of this invention comprises a photographically useful compound and a hydrophobic, photographically inert compound having a log $P_{(calc)}$ greater than about 9.

Photographically useful compounds are compounds which perform a desired function during the photographic process. Not all photographically useful compounds are subject to undesirable particle growth when in a dispersed liquid phase in an aqueous medium. The term "undesirable particle growth" means particle growth of greater than about 10% of the initial particle size. Generally, compounds which have a $\log P_{(calc)}$ less than about 9 are subject to undesirable particle growth. However, certain photographically useful compounds, such as the oxidized developer scavenger dioctyl hydroquinone, have $\log P_{(calc)}$ values greater than 9 yet are subject to undesired particle growth which is advantageously inhibited by the present invention. Photographically useful compounds subject to undesired particle growth as discussed herein generally have a relatively low molecular weight, i.e., below about 2,000. The following is an illustrative list of photographically useful compounds which may be subject to undesired particle growth in photographic dispersions.

1. Couplers having a log $P_{(calc)}$ less than about 9, for example, compounds of the formula:

STRUCTURE C-1

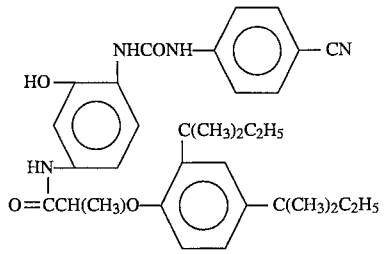

STRUCTURE C-2

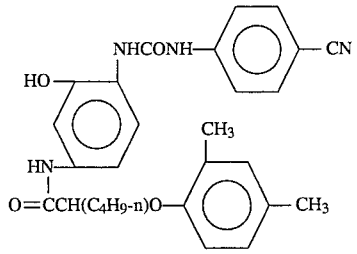

STRUCTURE C-3

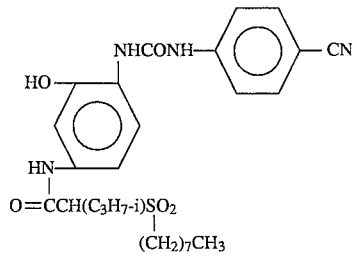

STRUCTURE C-4

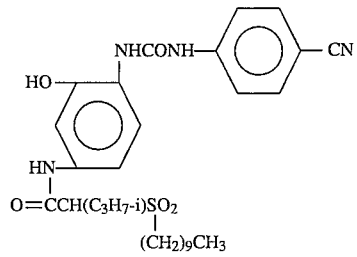

STRUCTURE C-5

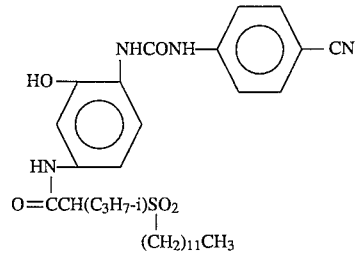

STRUCTURE C-6

-continued
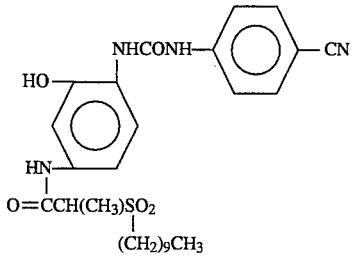
STRUCTURE C-7
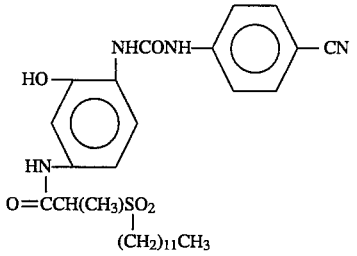
STRUCTURE C-8
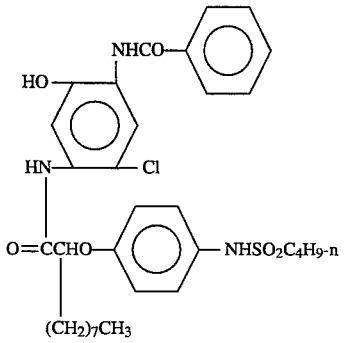
STRUCTURE C-9
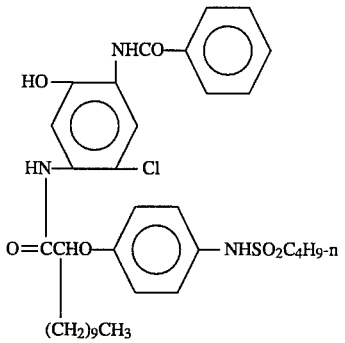
STRUCTURE C-10
-continued
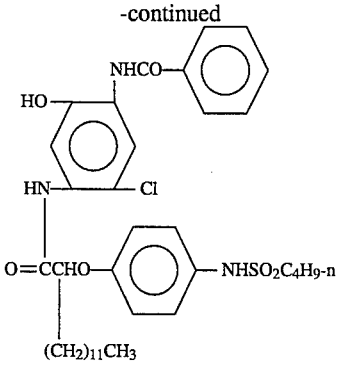
STRUCTURE M-1
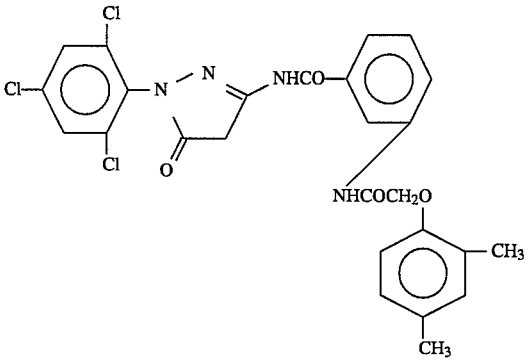
STRUCTURE M-2
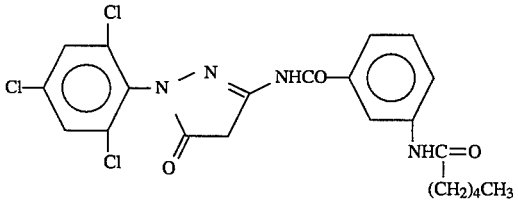
STRUCTURE M-3
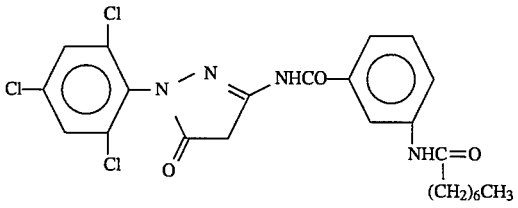
STRUCTURE Y-1
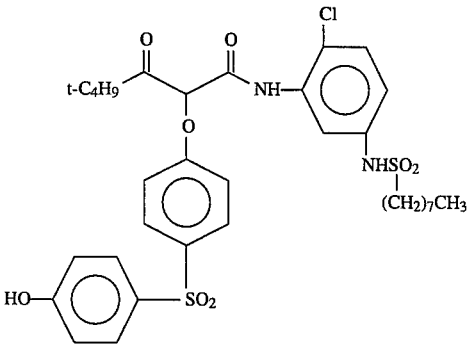

-continued

STRUCTURE Y-2

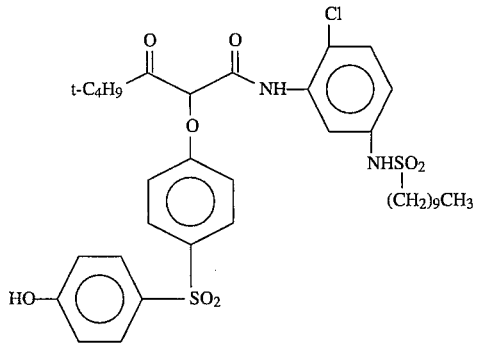

STRUCTURE Y-3

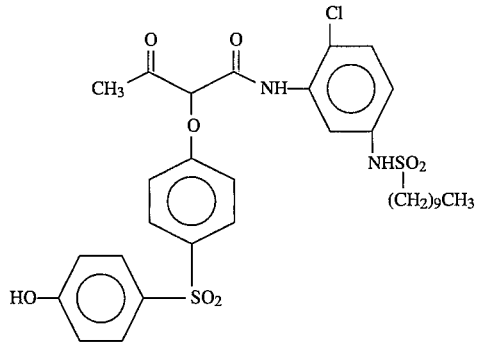

STRUCTURE Y-4

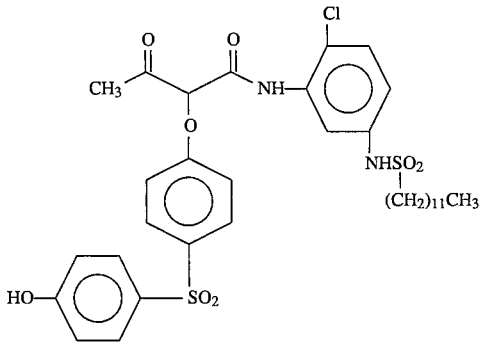

2. UV absorbers
3. Liquids for pressure sensitivity, lubrication, reactivity control, and the like
   a. alkyl phthalates
   b. aryl phthalates,
   c. alkyl amides,
   d. phosphates,
   e. polymerizable monomers
      i. acrylates
      ii. methacryates
      iii. vinyl derivatives
   f. phenols
   g. alcohols
   h. sulfoxides
   i. esters
   j. hydrocarbons
   l. alkyl halides
4. Oxidized Developer Scavengers
5. Optical Brighteners,
6. Incorporated Developers,
7. Anti fogging Agents, e.g.

The use of dispersions of organic liquids is described in various patents including U.S. Pat. No. 2,787,544 to Godowsky et al; U.S. Pat. No. 2,801,170 to Vittum et al; U.S. Pat. No. 4,419,441 to Nittel et al; and U.S. Pat. No. 5,008,179 to Chariet al; and British Pat. No. 1,077,426 to Greenhalgh. Oxidized developer scavengers are described in various patents, for example in U.S. Pat. No. 2,728,659 to Loria et al; U.S. Pat. No. 3,700,453 to Knechel; U.S. Pat. No. 3,982,944 to Ohi et al; and U.S. Pat. No. 4,366,236 to Takahashi. Compounds which protect photographic materials from the destructive effects of ultraviolet radiation have been described in various patents including U.S. Pat. No. 3,004,896 to Heller et al; U.S. Pat. No. 3,253,921 to Sawdey; U.S. Pat. No. 4,323,633 to Beretta; and U.S. Pat. No. 4,576,908 to Valarino. The entire disclosures of these patents are incorporated herein by reference.

Preferred photographically useful compounds subject to undesired particle growth which is inhibited by this invention are dibutyl phthalate; dipentyl phthalate; bis(2-ethylhexyl) sulfoxide; tricresyl phosphate; dioctyl hydroquinone; anisylidene-n-propylcyanoacetate; 3-N, N-di-n-hexylaminoallylidene malononitrile; butanamide, N-(4-((((4-cyanophenyl)amino)carbonyl)amino)- 3-hydroxylphenyl)-2-(dodecylsulfonyl)- 3-methyl; and the like.

In accordance with this invention, particle growth of such photographically useful compounds dispersed in an aqueous medium can be inhibited by the use of hydrophobic, photographically inert substances. The hydrophobic, photographically inert compounds used in this invention are either liquid or oil soluble solids and should have a $\log P_{(calc)}$ greater than about 9. Preferred hydrophobic, photographically inert compounds are those selected from the following classes of compounds:

I. alkanes, alkenes or alkyl halides having a $\log P_{(calc)}$ greater than about 9, II. liquid or oil soluble compounds which have an elemental composition consisting of carbon, hydrogen, and oxygen and a $\log P_{(calc)}$ greater than about 9, III. Esters and amides of sulfur or phosphorous acids having a $\log P_{(calc)}$ greater than about 9.

IV. Amides and amines having a $\log P_{(calc)}$ greater than about 9 and which do not solidify or gel the dispersed phase comprising the photographically useful compound.

Representative compounds are given below, along with their $\log P_{(calc)}$ value. Each Log $P_{(calc)}$ was calculated using the above-mentioned MedChem software package (version 3.54). This software package is well known and accepted in the chemical and pharmaceutical industries.

Compounds of class I include: straight or branched chain alkanes and alkenes having 16 to 30 carbon atoms such as, for example, hexadecane, octadecane, 2,2,6,6,9,9 hexamethyldodecane, eicosane, doeicosane, triacontane, or octadecene and haloalkanes such as hexadecyl bromide, octadecyl chloride, or 1,20 dibromo eicosane.

Compounds of class II include any liquid of oil soluble solid with a calculated $\log P_{(calc)}$ greater than about 9 and with an elemental composition consisting of carbon, hydrogen, and oxygen. Such compounds include, for example, alcohols having at least 20 carbon atoms, for example, eicosyl alcohol, triacontyl alcohol, or 6-eicosyl alcohol; carboxylic acids having at least 20 carbon atoms, for example eiconic acid, and triaconic acid; monoesters having at least 20 carbon atoms, for example, isopropyl stearate, butyl oleate, 2-ethylhexyl stearate; diesters having at least 24 carbon atoms, for example, bis(2-ethylhexyl) azelate, dibutyl sebacate, didecyl suberate, didecyl succinate and dioctadecyl succinate; substituted aromatic compounds, for example, phthalates, isophthalates, terephthalates containing at least a total of 18 carbon atoms in the substituent groups, such as, for example, dinonyl phthalate, didecylphthalate, didodecylphthalate, didecylterephthalate; phenols containing a total of at least 16 carbon atoms in the substituent groups, including, for example, 3-(4-hydroxy-3,5-di-t-butylphenyl)-propionic acid, octadecyl ester (commercially available under the trade mark Irganox 1076), para-hexadecyl phenol; and alkyl benzenes containing at least 14 carbon atoms in the substituent groups including tetradecyl benzene, hexadecyl benzene, octadecyl benzene.

Compounds of class III include esters and amides of sulfur or phosphorous acids including, for example, sulfates, sulfonates, sulfonamides, phosphates, phosphonates, phosphites, or phosphine oxides. Particular examples include diesters of sulfuric acid, such as, for example, didecylsulfate, didodecylsulfate, esters of various alkyl sulfonic acids including, for example, decyl decanesulfonate, octyl dodecanesulfonate, sulfonamides, including, for example, hexadecyl toluenesulfonamide, dodecyl dodecanesulfonamide, triesters of phosphoric acid containing at least a total of 24 carbon atoms, such as, for example, tri(2-ethylhexyl) phosphate, tridecylphosphate, or tridodecylphosphate, diesters of various alkyl phosphonic acids, containing a total of at least 24 carbon atoms, including, for example, dioctyl octylphosphonate, or didecyl butylphosphonate, or any trisubstituted phosphine oxide containing a total of at least 24 carbon atoms, including, for example, tri 2-ethylhexyl phosphine oxide, and tri-isooctyl phosphine oxide.

Compounds of class IV include: trioctyl amine.

Representative compounds and their respective $\log P_{(calc)}$ values are given below:

1. hexadecane (9.16)
2. bis (2-ethylhexyl)azelate (9.20)
3. tri (2-ethylhexyl) phosphate (9.49)
4. trioctylphosphine oxide (9.74)
5. dinonyl phthalate (9.98)
6. didecyl phthalate (11.04)
7. didodecyl phthalate (13.15)
8. 3-(4-hydroxy-3,5-di-t-butylphenyl)propionic acid, octadecyl ester (14.07)
9. trioctyl amine (10.76)

Some of the hydrophobic, photographically inert compounds useful in the practice of this invention have been disclosed to be useful in photographic dispersions as permanent solvents for couplers. Couplers generally have a $\log P_{(calc)}$ greater than about 9 and are not be subject to particle growth when in a dispersed phase in aqueous media. See, for example, U.S. Pat. No. 4,181,527 to Toda et al, U.S. Pat. No. 4,193,802 to Mukunoki et al, U.S. Pat. No. 4,407,940 to Nakamura et al, U.S. Pat. No. 4,614,709 to Sasaki et al, U.S. Pat. No. 4,770,983 to Ogawa et al, U.S. Pat. No. 4,791,050 to Ogawa et al, U.S. Pat. No. 4,945,034 to Tanji et al, U.S. Pat. No. 4,983,507 to Takahashi et al and U.S. Pat. No. 5,006,456 to Morigaki et al.

The preferred amount of hydrophobic, photographically inert substance for use in this invention is a level less than the total amount of photographically useful compound (PUC) in the dispersed phase. The preferred level of hydrophobic, photographically inert substance is 0.01% to 90% of the PUC level in the dispersed phase, the more preferred level of hydrophobic, PUC is 0.1 to 25% of the photographically useful compound level in the dispersed phase. The most preferred level of hydrophobic, photographically useful compound is 1 to 10% of the PUC level in the dispersed phase.

The dispersions of this invention preferably are prepared by codissolving the photographically useful compound and the photographically inert compound in a permanent and/or an auxiliary solvent and then dispersing the resulting solution in the aqueous medium. The permanent solvent, if present, is a solvent which remains in the photographic dispersion. The use of permanent solvents for use in incorporating water insoluble compounds into photographic dispersions as a dispersed phase are well known. We have discovered that undesired particle growth is a problem if each dispersed phase component, including the permanent solvent employed has a $\log P_{(calc)}$ less than about 9. Such solvents include, for example:

n-Hexylphenylcarbinol
2-(p-tert, butylphenoxy)-ethanol
Acetyl n-butyl aniline
Acetyl methyl ρ-toluidine
Benzoyl piperdine
N-n-amylphthalimide
N-n-amyl succinimide
N-2-cyanobutylphthalimide
N,N-di-ethyl-dodecanamide
N,N-di-methyl dodecanamide
N,N-di-propyl dodecanamide
di-tert.-amyl phenol
phenoxy toluene
bis-ethylhexyl sulfoxide
acetyl tributyl citrate
tributyl citrate
ethylhexyl hydroxy benzoate
ethylhexyltoluene sulfonamide
undecyl alcohol
diethyl sebacate
dimethyl sebacate
ethyl phenylacetate
triethyl citrate
1,4-cyclohexylenedimethylene bis(2-ethylhexanoate)
Ethyl N,N-di-n-butyl carbamate
Ethyl N-phenyl carbamate
Tetrahydrofurfuryl benzoate
di-Tetrahydrofurfuryl succinate
Ethyl benzyl malonate
di ethyl phthalate
di butyl phthalate
di pentyl phthalate
di isoamyl phthalate
di benzyl phthalate
di methoxyethyl phthalate
di ethoxyethyl phthalate
di butoxyethyl phthalate
ethyl naphthoate
methyl methoxybenzoate
butyl methoxy benzoate
naphthyl acetate
methyl phthalylethyl glycollate butyl phthalylbutyl glycollate
resorcinol diacetate
hexyl benzoate
benzophenone
dicholorbenzophenone
methoxy acetophenone
acetophenone
2,4-dihydroxy valerophenone
ρ-sec-amylbenzophenone
triphenyl phosphate
tricresylphosphate
trihexyl phosphate
diphenyl mono-ρ-tert. butyl phenyl phosphate
monophenyl di-ρ-tert. butyl phenyl phosphate
diphenyl mono-o-chlorophenyl phosphate
monophenyl di-o-chlorophenyl phosphate
tri-ρ-tert. butyl phenyl phoshate
tri-o-phenylphenyl phosphate
di-ρ-tert. butyl phenyl mono (5-tert. butyl-2-phenylphenyl) phosphate
ρ-toluenesulfonyl methyl o-toluidine
ρ-toluenesulfonyl dimethylamide
ρ,ρ'-di-n-amylbenzenesulfonanilide
n-butylsulfone
iso-amyl sulfone
N,N'-diethyl-N,N'-diphenyl urea
N,N'-di-n-butyl urea and the like.

The use of auxiliary solvents is also well known. Auxiliary solvents are removed from the dispersion by evaporation, washing or dialysis. Illustrative auxiliary solvents are ethyl acetate, butoxyethyl acetate, methyl isobutyl ketone, methyl acetate, 2-methyl tetrahydrofuran, isobutyl acetate, 2-ethoxyethyl acetate, 2-(2-butoxyethoxy) ethyl acetate, 4-methyl-2-pentanol, diethyl carbitol, triethyl phosphate, cyclohexanone, 2-benzyloxyethanol, 2-(2-ethoxyethoxy) ethyl acetate, methylene chloride, 1,1,2-trichloroethane, 1,2-dichloropropane, and the like.

The photographically useful compound and the hydrophobic, photographically inert compound co-dissolved in the permanent and/or auxiliary solvent, is then dispersed in an aqueous medium by known techniques. For example, colloid milling, homogenization, sonification, high-shear mixing, and the like. After the dispersion step, the auxiliary solvent can be removed.

A further aspect of this invention comprises a photographic element comprising a support and a layer prepared from a stabilized dispersion as described above. Typically, the aqueous medium contains a hydrophilic colloid, such as gelatin, and may also contain silver halide grains. Photographic emulsions comprising silver halide particles are well known. If the dispersion contains silver halide grains, the photographic element may contain a layer comprising the dispersion of this invention as the only layer or only photosensitive layer. However, in preferred embodiments of this aspect of the invention, the photographic element comprises a plurality of layers, at least one of which is prepared from a stabilized dispersion of this invention and at least one other of which comprises a photosensitive silver halide emulsion.

Coating a photographic support with photographic dispersions is well known and the dispersions of this invention can be applied to a support in any suitable process. Suitable methods are described for example in Research Disclosure 308119 (December 1989) section XV.

In preferred embodiments of this invention the support is paper. As described more fully below in examples 14 through 16, paper prepared in which a dispersion of this invention is positioned as an interlayer between color sensitive layers has improved wet scratch resistance and interlayer color contamination resistance. Also, the use of a dispersion of this invention in the outermost protective layer improves the haze in photographic paper. In other embodiments the support is film.

The following examples illustrate the use of a hydrophobic, photographically inert compound to prevent the growth of particles of a photographically useful compound in a dispersed phase in an aqueous photographic dispersion.

EXAMPLE 1

A dispersion to reduce pressure sensitivity in silver halide color photosensitive materials was prepared in the following way:

3.20g of Type IV gelatin, together with 3.2 g of a 10% aqueous solution of Alkanol XC (DuPont), was dissolved in 31.48g of water at 45° C. A solution consisting of 7.5 g dipentylphthalate and 7.5 g of ethyl acetate was added to the aqueous gelatin solution. The resulting mixture was stirred with a glass rod and vigorously sheared for 3 minutes with an Ultra-Turax high shear mixer. This dispersion was evaporated in a rotary evaporator for 5 minutes at 65° C. to remove all ethyl acetate. All mass lost during evaporation (ethyl acetate and some water) was replaced with water to achieve a 15% dispersion of dipentyl phthalate. This dispersion is referred to a dispersion A. Dispersion B was prepared as above except the dipentyl phthalate was replaced with 6.75 g of dipentyl phthalate and 0.75 g of didodecyl phthalate. These two dispersions were incubated at 45° C. for several days, and the average particle size of the dispersion was measured periodically using the Sedimentation Field Flow Fractionation technique (DuPont) (see FIG. 1—particle sizes are normalized with respect to their initial value at the start of incubation, i.e., the particle diameter/initial particle diameter is reported). As can be seen, dispersion B (included in the present invention) does not show any growth in particle size over 2 days of incubation, whereas the prior art dispersion (dispersion A) shows substantial particle growth.

EXAMPLE 2

Figure 2:
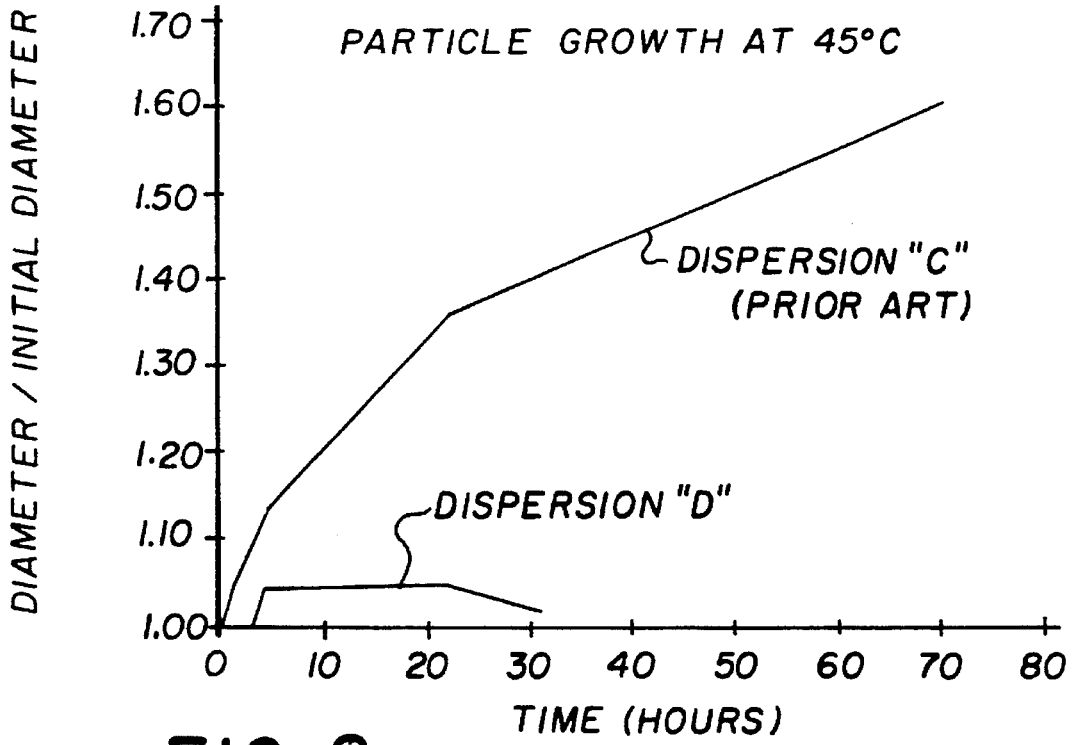

A dispersion was prepared similar to A above, except the dipentyl phthalate was replaced with bis(2-ethylhexyl)sulfoxide (dispersion C, prior art). Dispersion D (this invention) was prepared as above, except the bis(ethylhexyl)sulfoxide was replaced with 6.75 g of bis(2-ethylhexyl)sulfoxide and 0.75 g of didodecyl phthalate. C and D were incubated at 45° C. for several days, and average particle sizes were measured periodically. As can be seen in FIG. 2, the present invention (D) shows no change in particle size whereas the prior art (C) shows substantial particle growth.

EXAMPLE 3

Figure 3:
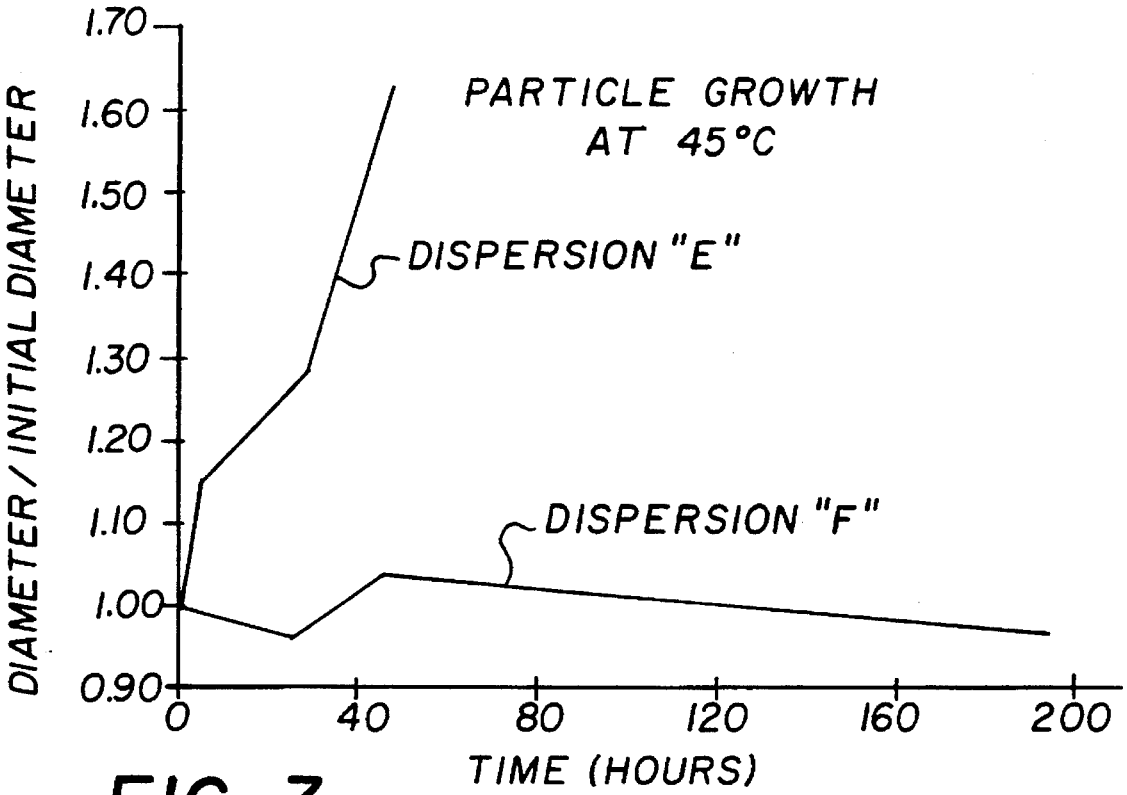

Dispersion E was prepared identically to dispersion C above. Dispersion F was similarly prepared except 6.75 g of bis(2-ethylhexyl)sulfoxide and 0.75 g of Irganox 1076 (a solid at room temperature and 45° C.) was used instead of bis(2-ethylhexyl)sulfoxide and didodecylphthalate. Upon incubation, the embodiment of the present invention (F) showed no particle growth, while the prior art dispersion (E)

exhibits substantial particle growth (see FIG. 3). Thus solids or liquids can be employed as the highly hydrophobic compound of this invention.

EXAMPLE 4

Figure 4:
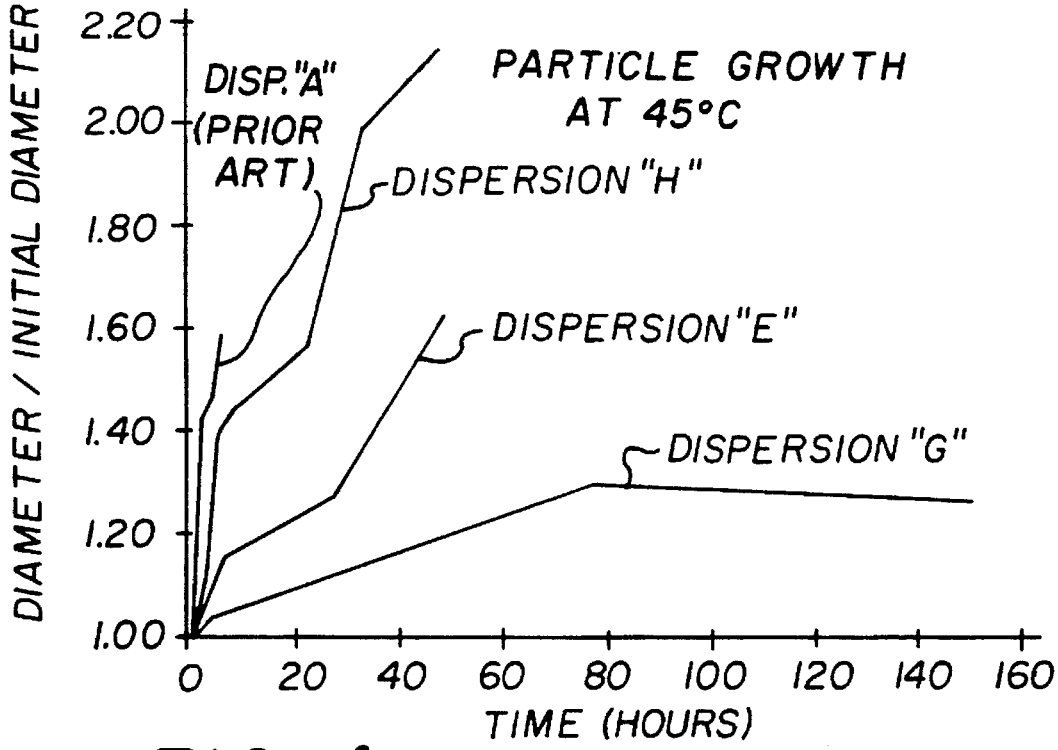

A dispersion of 6.75 g bis(ethylhexyl) sulfoxide and a 0.75 g hexadecane ($\log P_{(calc)}$=9.16) was prepared as above (dispersion G). A similar dispersion of 6.75 g dipentyl phthalate and 0.75 g tridecylbromide ($\log P_{(calc)}$=7.42) was similarly prepared (dispersion H). Thus, dispersion G is an embodiment of the present invention while H lies outside the scope of our invention. As can be see in FIG. 4, the prior art (dispersion A and E) and dispersion H show substantial particle growth, while our invention, as illustrated in dispersion G, shows very little particle growth.

EXAMPLE 5

Figure 5:
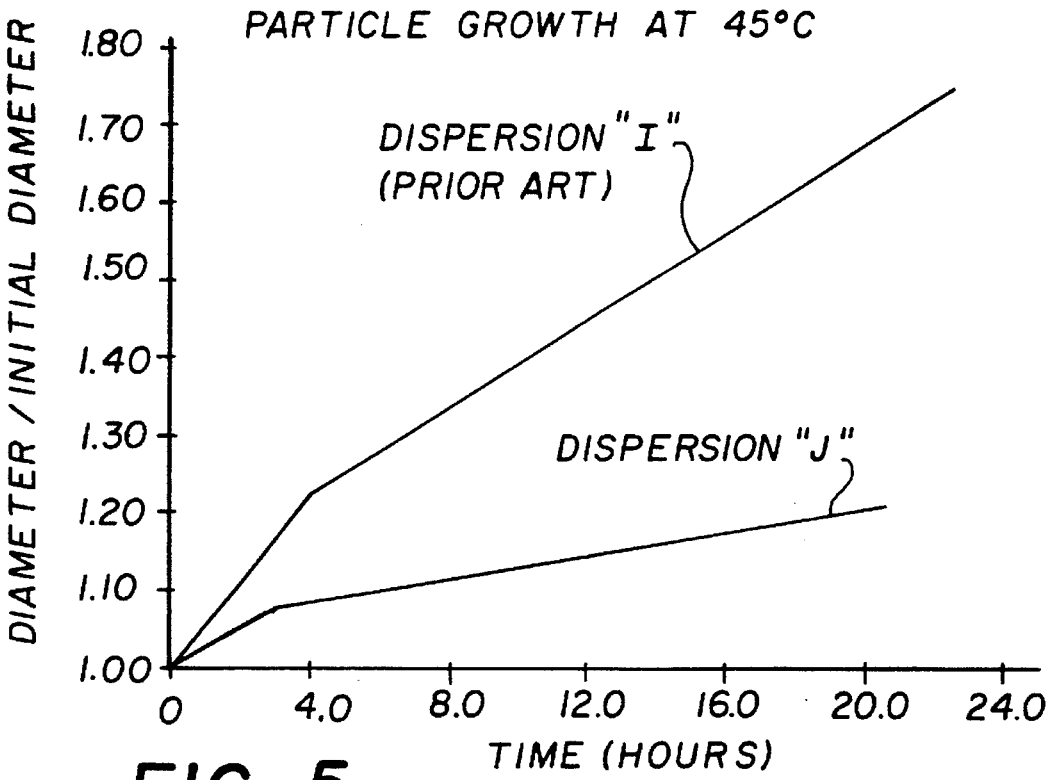

Dispersion I was prepared similarly to dispersion E. Dispersion J was prepared by replacing the bis(ethylhexyl-)sulfoxide of dispersion I with 7.425 g of bis(2-ethylhexyl)sulfoxide and 0,075 g of didodecyl phthalate. A comparison of the particle growth at 45° C. (FIG. 5) reveals that our invention (dispersion J) substantially slows growth compared to the prior art (I). Thus, even very small amounts of a highly hydrophobic material gives a substantial advantage.

EXAMPLE 6

Figure 6:
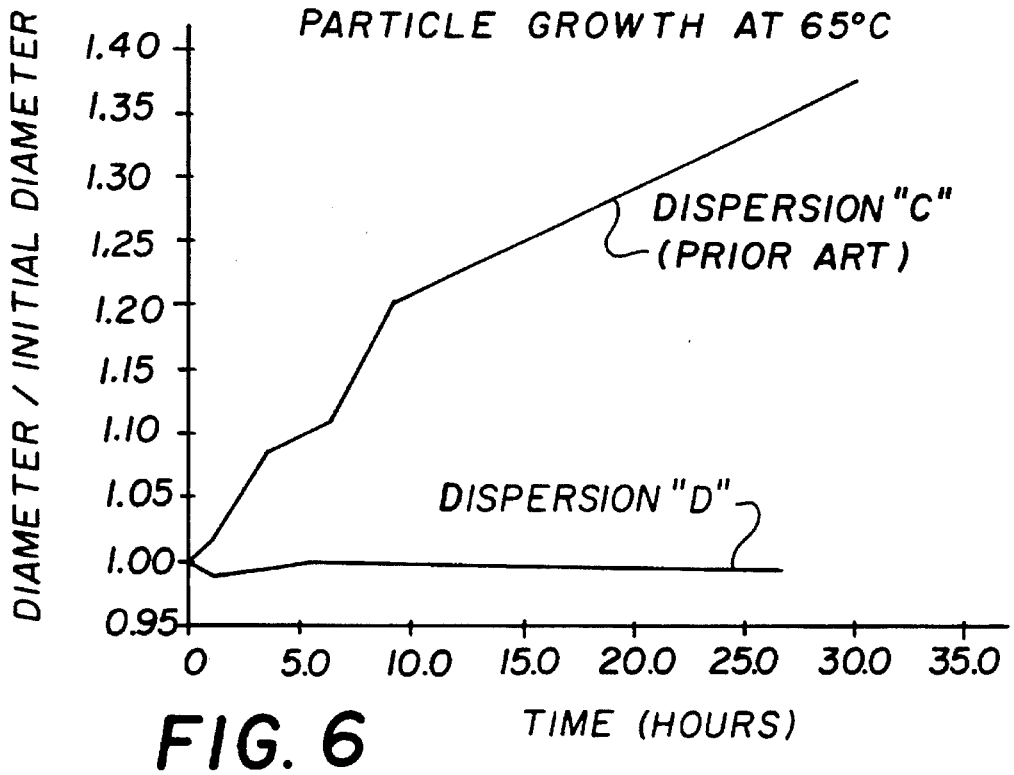

Portions of dispersion C (prior art) and dispersion D (our invention) were incubated at 65° C. for several days. FIG. 6 demonstrates that our invention prevents particle growth even at extreme temperatures.

EXAMPLE 7

Figure 7:
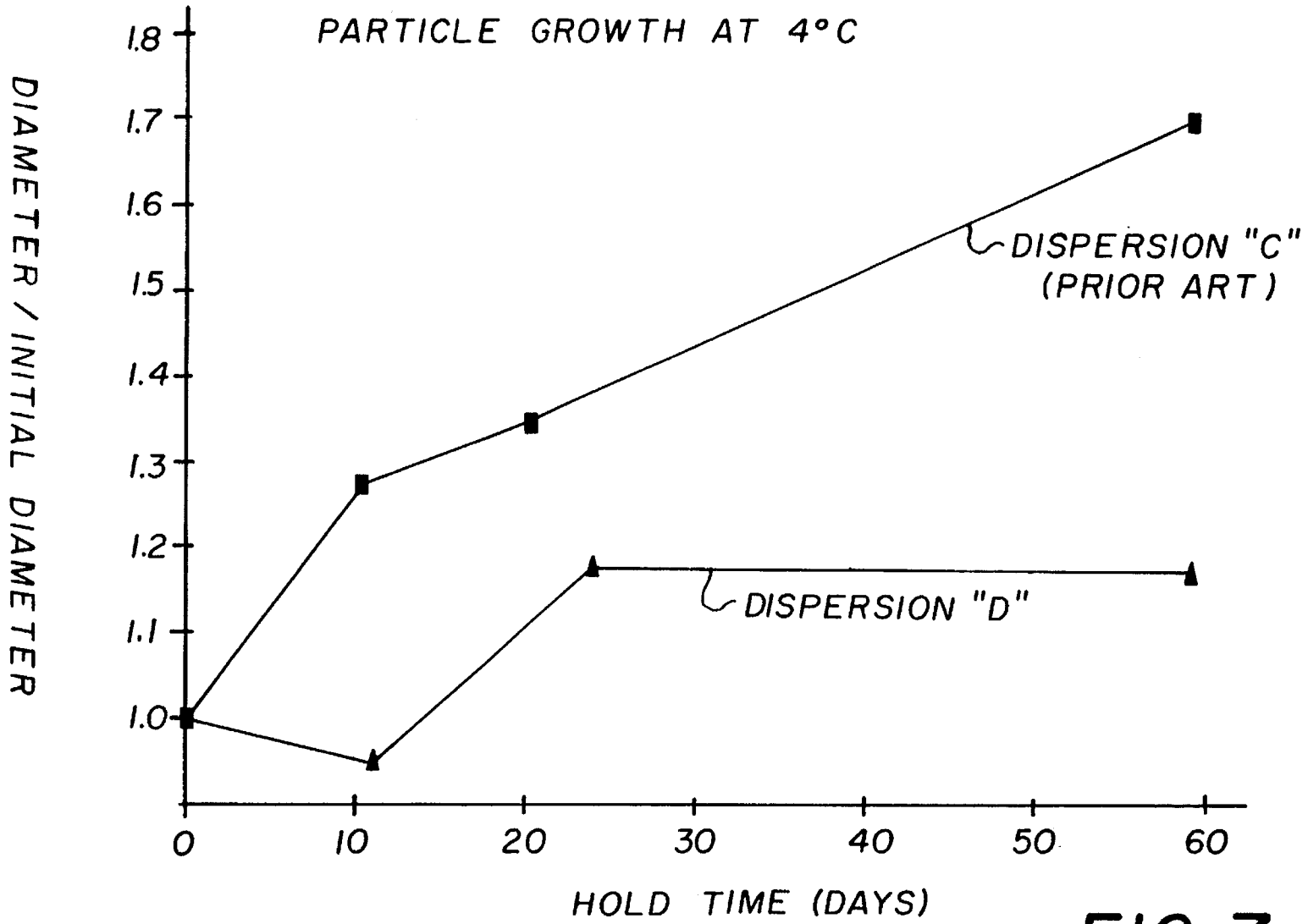

Portions of dispersions E (prior art) and G (our invention) were stored at 4° C. for several months. FIG. 7 illustrates that our invention prevents long term particle growth at low (storage) temperatures.

EXAMPLE 8

Figure 8:
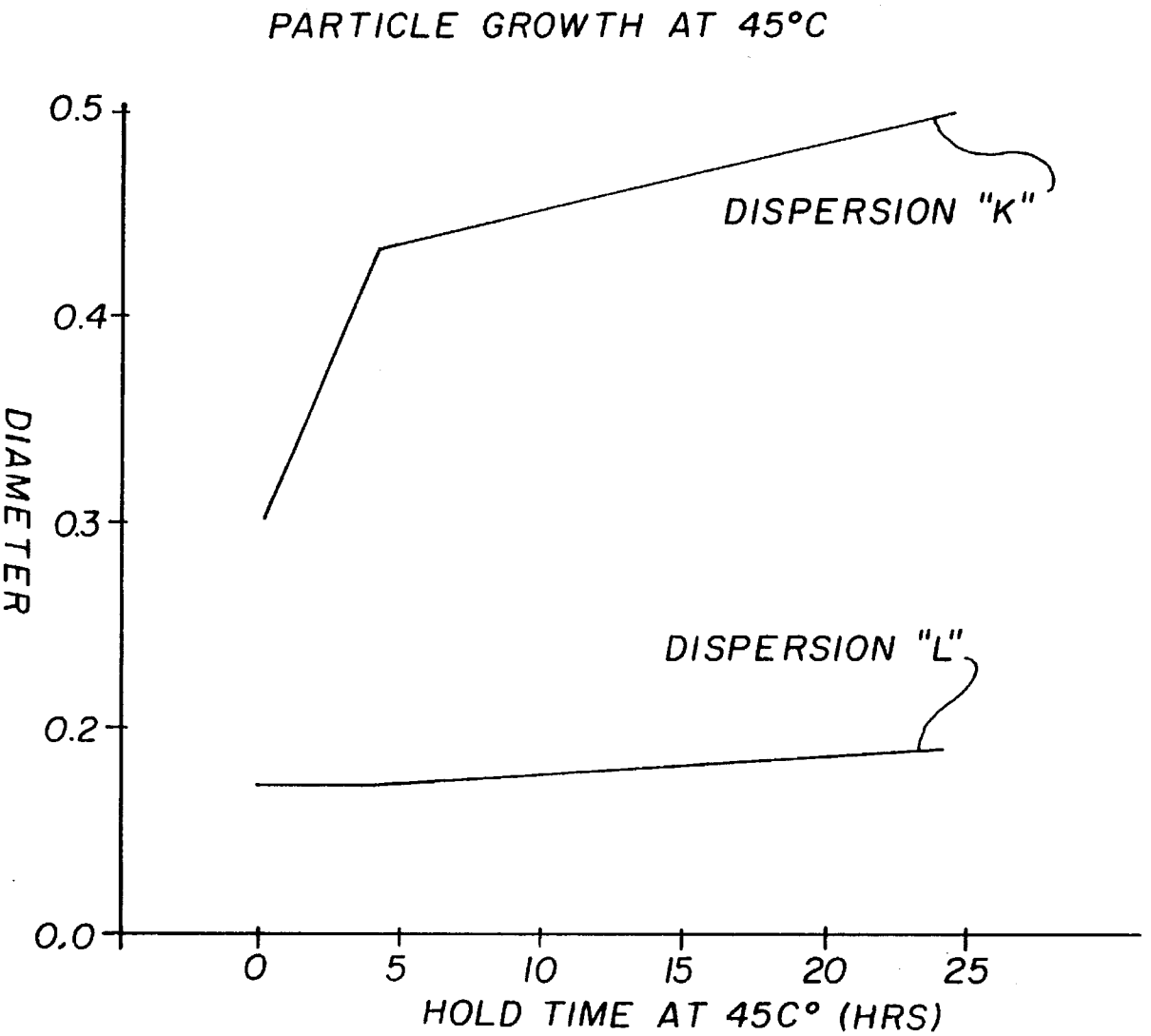

A dispersion used to reduce pressure sensitivity in silver halide color photographic materials was prepared in the following manner: 24.0 g of 50% Type IV gelatin and 12.0 g of a 10% solution of Alkanol XC (DuPont) were dissolved in 116.0 g of distilled water at 50° C. A solution of 24.0 g of tri-cresyl phosphate and 24.0 g of ethyl acetate was also heated to 50° C., then added to the aqueous gelatin solution. The resulting mixture was stirred with a glass rod and passed through a Gaulin colloid mill 5 times. The ethyl acetate was removed from this dispersion using a rotary evaporator for 15 minutes at 60° C. All mass lost during evaporation was replaced with water to obtain a 12% tri-cresyl phosphate dispersion. This dispersion is referred to as dispersion K. Dispersion L was prepared as above except that 2.4 g of didecylphthalate was added to the oil phase solution. These two dispersions were incubated at 45° C. for 0, 4, and 24 hours and the average particle size was measured using a turbidimetry technique. The data in FIG. 8 show that substantial particle growth occurred with dispersion K (prior art) while little growth was observed with dispersion L (present invention).

EXAMPLE 9

Figure 9:
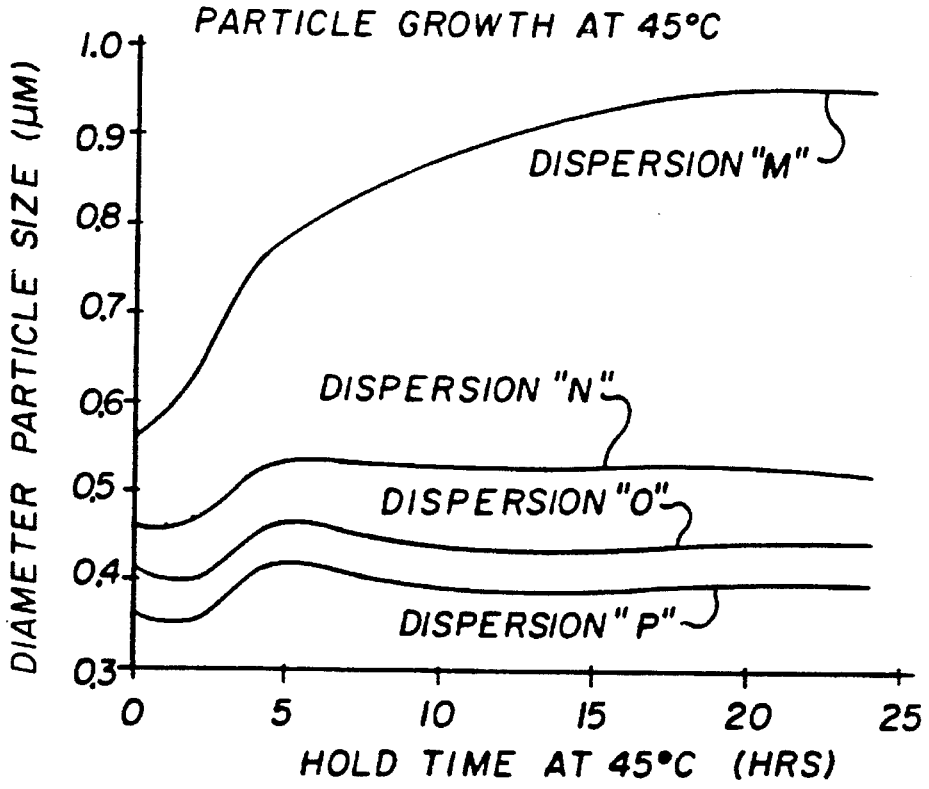

An oxidized developer scavenger used in silver halide color photographic materials was prepared in the following manner: 89.1 g of Type IV gelatin and 21.3 g of a 10% solution of Alkanol-XC (DuPont) were dissolved in 649.6 g of distilled water at 60° C. 60.0 g of di-octylhydroquinone was dissolved in 180.0 g of dibutylphthalate at 100° C., then added to the aqueous gelatin solution. The resulting mixture was pre-mixed for 2 minutes using a Brinkman high shear mixer at 6000 RPM and passed through a Crepaco homogenizer one time at 5000 PSI. This dispersion is referred to as dispersion M. Dispersions N, O, and P were prepared as above except that 5.3 g, 8.9 g, and 17.8 g, respectively, of didecylphthalate was substituted for an equal weight amount of dibutyl phthalate. These four dispersions were incubated for 0, 2, 4, 7, and 24 hours at 45° C. and the average particle size was measured as in Example 8. The data plotted in FIG. 9 indicate that substantial particle growth is seen in dispersion M (prior art), while very little growth was observed with dispersions N, O, and P (present invention).

EXAMPLE 10

Figure 10:
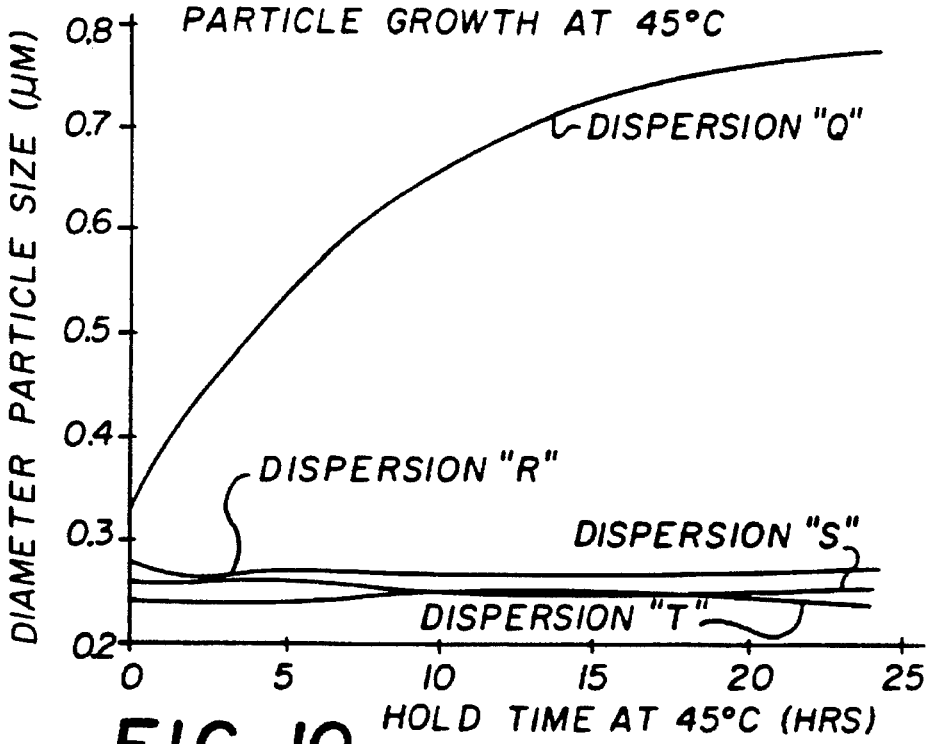

An oxidized developer scavenger dispersion was prepared in the following manner: 89.8 g of Type IV gelatin and 83.6 g of a 10% solution of Alkanol XC (DuPont) were dissolved in 661.6 g of distilled water at 60° C. 60.0 g of di-octyl hydroquinone was dissolved in 105.0 g of dibutylphthalate at 100° C., then added to the aqueous gelatin solution. The resulting mixture was dispersed as described in Example 9 and is referred to as dispersion Q. Dispersions R, S, and T were prepared as above except that 3.2 g, 5.2 g, and 10.5 g, respectively, of didecylphthalate was substituted for an equal weight amount of dibutylphthalate. These four dispersions were incubated for 0, 2, 4, 7, and 24 hours at 45° C. and the average particle size was measured as in Example 8. The date in FIG. 10 show substantial particle growth with dispersion Q (prior art) and little or no growth with dispersions R, S, and T (present invention).

EXAMPLE 11

Figure 11:
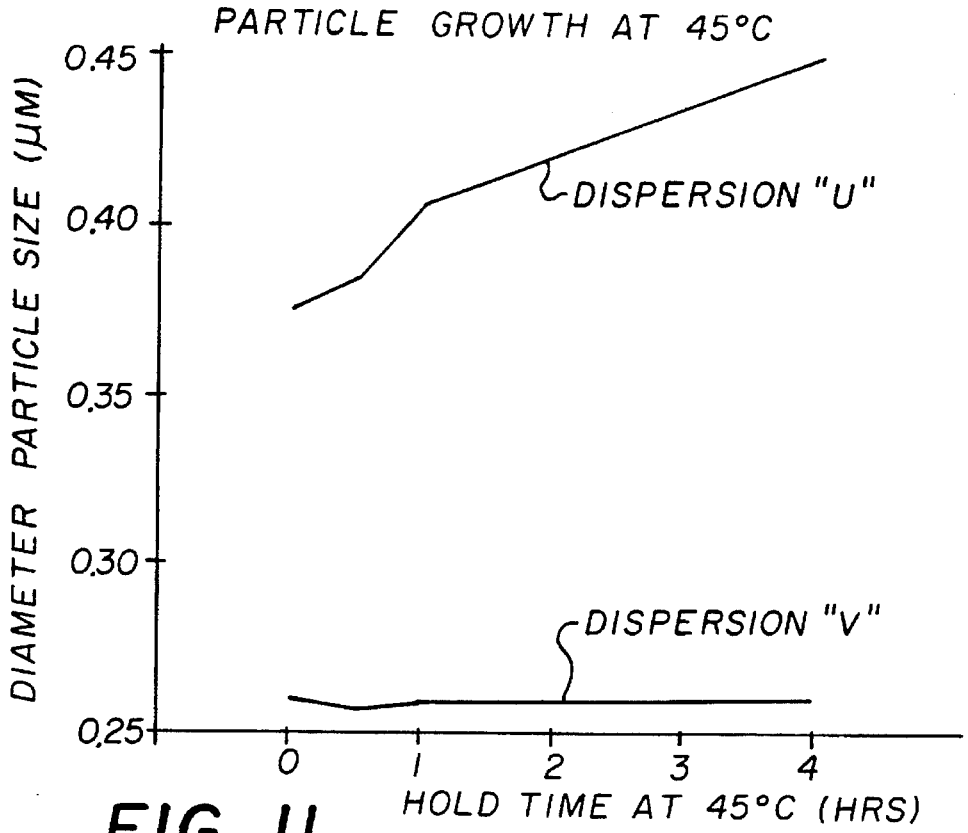

An ultraviolet absorber dispersion used in silver halide color photographic materials was prepared in the following manner: 24.0 g of 50% Type IV gelatin and 12.0 g of a 10% solution of Alkanol XC (DuPont) were dissolved in 128.0 g of distilled water at 50° C. 12.0 g of the UV absorbing compound 3-di-n-hexylaminoallylidenemalononitrile was dissolved in 12.0 g of dibutylphthalate and 12.0 g of ethyl acetate at 60° C., then added to the aqueous gelatin solution. The resulting mixture was dispersed as described in Example 8. This dispersion is referred to as dispersion U. Dispersion V was prepared as above except that 12.0 g of dibutylphthalate was replaced by 10.8 g of dibutylphthalate and 1.2 g of didecylphthalate. These two dispersions were incubated at 45° C. for 0,0.5,1,2, and 4 hours and the average particle size was measured as in Example 8. The data in FIG. 11 show that substantial particle growth occurred with dispersion U (prior art) while little to no growth was observed with dispersion V (present invention). It is also evident that the initial particle size obtained with dispersion V is considerably smaller than that of dispersion U.

EXAMPLE 12

Figure 12:
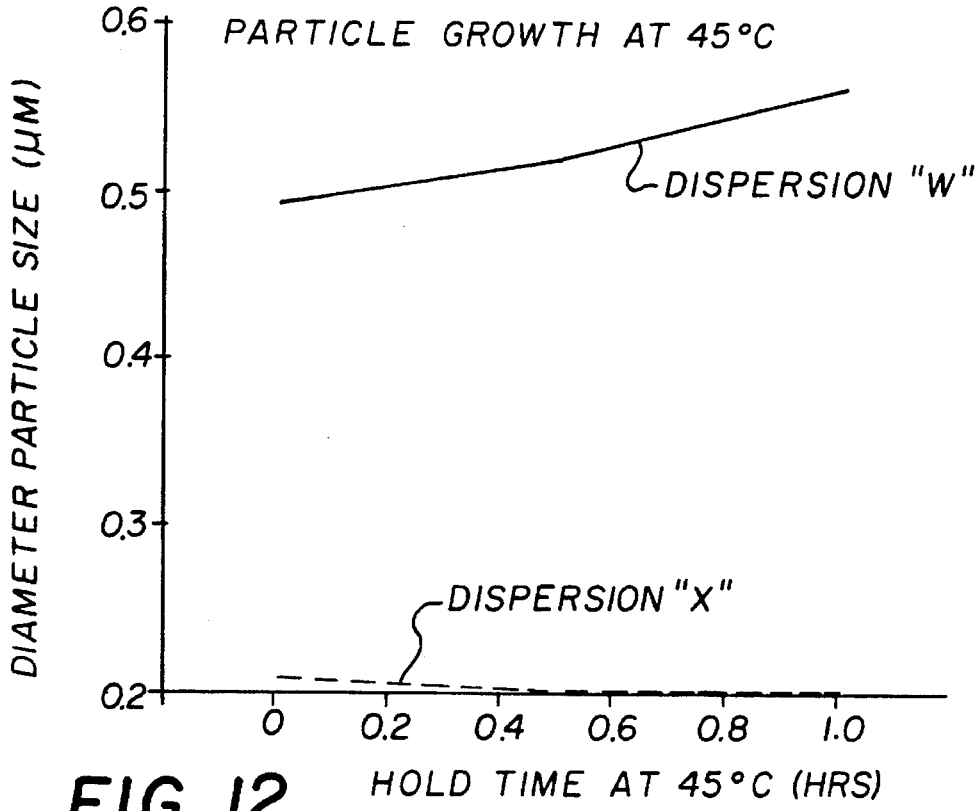

An ultraviolet absorber dispersion used in silver halide color photographic materials was prepared in the following manner: 24.0 g of 50% Type IV gelatin and 12.0 g of a 10% solution of Alkanol XC (DuPont) were dissolved in 128.0 g of distilled water at 50° C. 12.0 g of UV absorbing compound anisylidene-n-propylcyanoacetate was dissolved in 12.0 g of dibutylphthalate and 12.0 g of ethyl acetate at 60° C., then added to the aqueous gelatin solution. The resulting mixture was dispersed as described in Example 8. This dispersion is referred to as Dispersion W. Dispersion X was prepared as above except that 12.0 g of dibutylphthalate was replaced by 10.8 g of dibutylphthalate and 1.2 g of didecylphthalate. These two dispersions were incubated at 45° C. for 0, 0.5, 1, 2, and 4 hours and the average particle size was measured as in Example 8. The data in FIG. 12 show that substantial particle growth occurred with dispersion W (prior art) while little or no growth was observed with dispersion X (present invention). It is also evident that the initial particle size obtained with dispersion X is considerably smaller than that of dispersion W.

EXAMPLE 13

Figure 13:
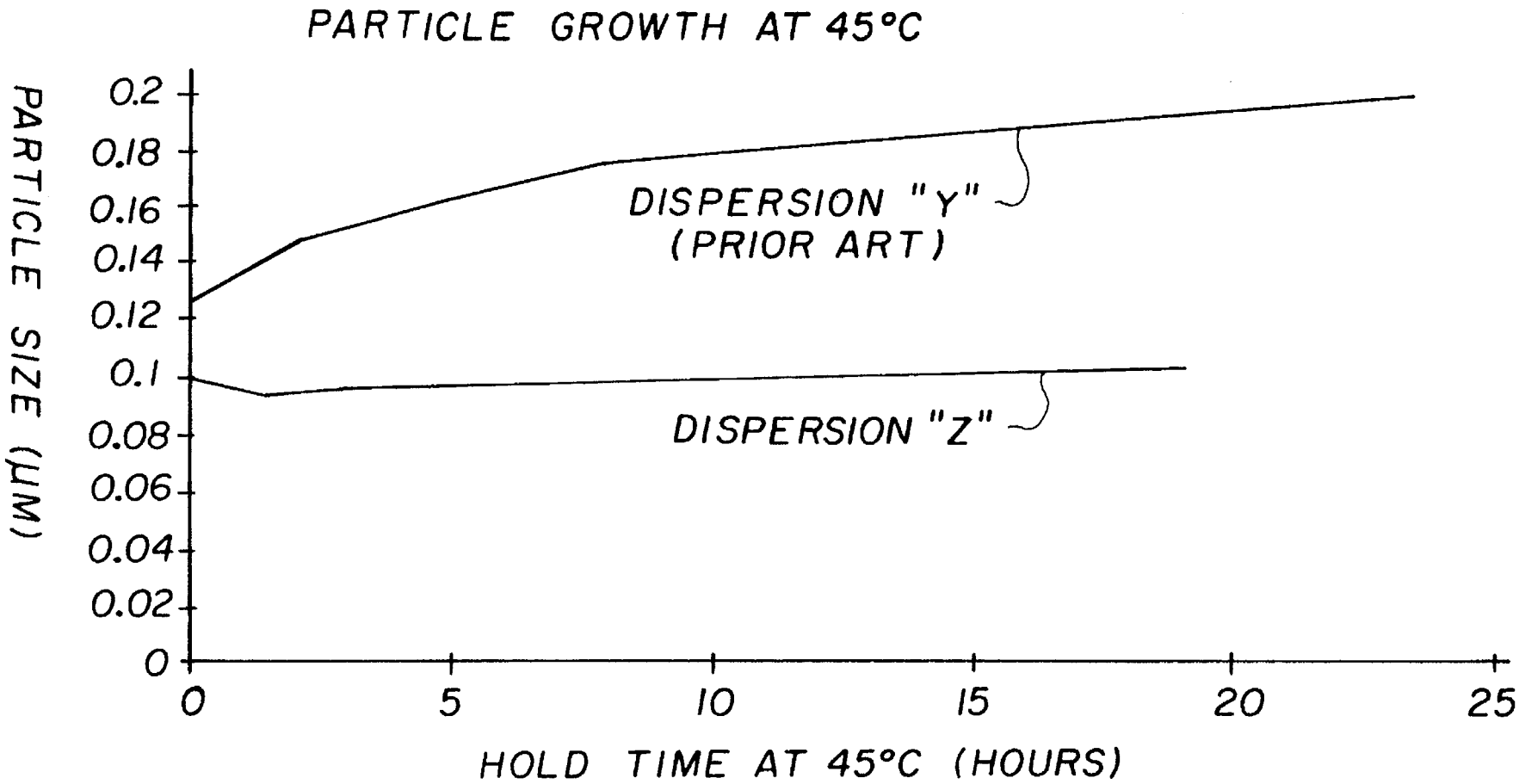

A dispersion of a coupler capable of reacting with the oxidized form of a color developer to form a cyan dye in a photographic element was prepared by dissolving 2 g of compound C-5 in 2 g of dibutyl phthalate and 4 g of ethyl acetate, dispersing this solution into an aqueous solution consisting of 2 g of Type IV gelatin, 2 g of a 10% solution Of Alkanol XC and 21.33 g of water, milling six times using a Gaulin colloid mill, evaporating at 65° C. for 5 minutes and replacing all lost mass with water to achieve a 6% dispersion of compound C-5. This dispersion represents the prior art and will be referred to as Dispersion Y. Dispersion Z was made similarly except 0.2 g of the dibutyl phthalate was replaced with 0.2 g of didecylphthalate. These dispersions were then incubated at 45° for one day, and small samples were taken periodically and measured by SFFF for particle size. As can be seen in FIG. 13, Dispersion Y (prior art) demonstrated substantial particle growth, while Dispersion Z (present invention) showed little or no growth in particle size.

EXAMPLE 14

An oxidized developer scavenger dispersion was prepared in the following manner: 89.1 g of Type IV gelatin and 21.3 g of a 10% solution of Alkanol-XC (DuPont) were dissolved in 649.6 g of distilled water at 60° C. 60.0 g of dioctyl hydroquinone was dissolved in 180.0 g of dibutyl phthalate at 100° C., then added to the aqueous gelatin solution. The resulting mixture was premixed for two minutes using a Brinkman High shear mixer at 6000 RPM, and passed through a Crepaco homogenizer one time at 5000 psi. This dispersion is referred to as dispersion AA (prior art). Dispersion AB (invention) was prepared as above except that 8.6 g of 3-(4-hydroxyphenyl- 3,5-di-butyl)-propionic acid, octadecyl ester was substituted for an equal weight amount of dibutyl phthalate, and an additonal 38.5 g of Alkanol XC was substituted for an equal weight of distilled water.

The wet scratch resistance of each of Dispersions AA and AB was evaluated in the paper structures as set forth below. Compounds used in the paper structures have the following formulas:

FORMULA 14-1:

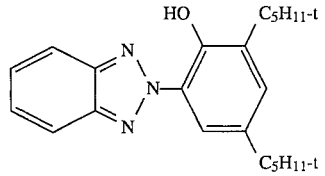

FORMULA 14-2:

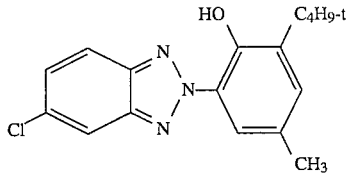

FORMULA 14-3:

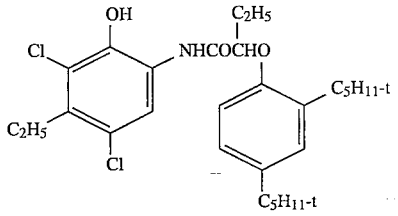

FORMULA 14-4:

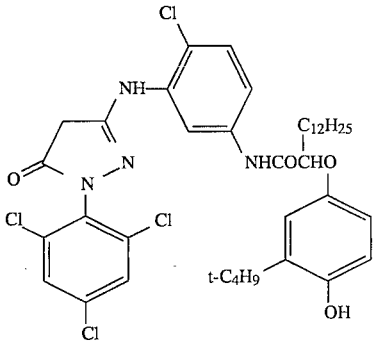

FORMULA 14-5:

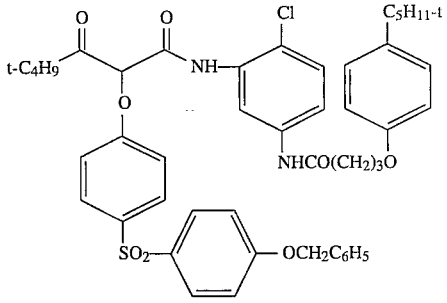

Paper Structure I (Prior Art)

Protective Gel Layer with 1.07g/m2 of Gelatin
.021 g/m2 of Dioctyl hydroquinone

.27 g/m2 of the compound of Formula 14-1
.05 g/m2 of the compound of Formula 14-2
.63g/m2 of Gelatin
UV Absorber Layer
.04 g/m2 of Dioctyl hydroquinone -continued 1.09 g/m2 of Gelatin
Red Sensitive Layer
.42 g/m2 of the compound of Formula 14-3
.21 g/m2 of Ag .27 g/m2 of the compound of Formula 14-1
.05 g/m2 of the compound of Formula 14-2
.63g/m2 of Gelatin
Inter/UV Absorber Layer
.04 g/m2 of Dioctyl hydroquinone 1.27 g/m2 of Gelatin
.39 g/m2 of the compound of Formula 14-4
Green Sensitive Layer
.28 g/m2 of Ag Interlayer with .75 g/m2 of Gelatin
.09 g/m2 of Dioctyl hydroquinone from Dispersion AA 1.51 g/m2 of Gelatin
Blue Sensitive Layer
1.08 g/m2 of the compound of Formula 14-5
.28 g/m2 of Ag Paper Support Paper Structure II (Invention)

Protective Gel Layer with 1.07g/m2 of Gelatin
.021 g/m2 of Dioctyl hydroquinone

.27 g/m2 of the compound of Formula 1'4-1
.05 g/m2 of the compound of Formula 14-2
.63g/m2 of Gelatin
UV Absorber Layer
.04 g/m2 of Dioctyl hydroquinone 1.09 g/m2 of Gelatin
Red Sensitive Layer
.42 g/m2 of the compound of Formula 14-3
.21 g/m2 of Ag .27 g/m2 of the compound of Formula 14-1
.05 g/m2 of the compound of Formula 14-2
.63g/m2 of Gelatin
Inter/UV Absorber Layer
.04 g/m2 of Dioctyl hydroquinone 1.27 g/m2 of Gelatin
.39 g/m2 of the compound of Formula 14-4
Green Sensitive Layer
.28 g/m2 of Ag Interlayer with .75 g/m2 of Gelatin
.09 g/m2 of Dioctyl hydroquinone from Dispersion AB 1.51 g/m2 of Gelatin
Blue Sensitive Layer
1.08 g/m2 of the compound of Formula 14-5
.28 g/m2 of Ag Paper Support As will be noted, the only difference between paper structures I and II is that the interlayer in structure I contains dioctyl hydroquinone coated from Dispersion AA while structure II contains dioctyl hydroquinone coated from Dispersion AB.

The paper of Structures I and II were tested for wet strength using the following procedure:

1. The paper was immersed in color paper developer solution for 30 seconds at 91 degrees F.
2. A 0.012 inch (radius of curvature) sapphire stylus was run over the coating applying 10 grams of force for every inch of travel of the stylus.
3. The force necessary to scratch the coating was calculated by measuring the distance until the scratch appears on the coating.

The results are shown in the following Table I.

TABLE I

| Paper | Wet Scratch (grams) |
|---|---|
| Structure I | 47 |
| Structure II | 79 |

These results show a 70% improvement in wet scratch resistance when Dispersion AB is used compared to Dispersion AA.

EXAMPLE 15

The interlayer color contamination of paper (Structure III, below) prepared in accordance with the prior art was compared to paper (Structure IV, below) prepared in accordance with this invention.

Paper Structure III (Prior Art)

Protective Gel Layer with 1.07 g/m2 of Gelatin
.021 g/m2 of Dioctyl hydroquinone .27 g/m2 of the compound of Formula 14-1
.05 g/m2 of the compound of Formula 14-2
.63 g/m2 of Gelatin
UV Absorber Layer
.04 g/m2 of Dioctyl hydroquinone 1.09 g/m2 of Gelatin
Red Sensitive Layer
.42 g/m2 of the compound of Formula 14-3
.21 g/m2 of Ag .27 g/m2 of the compound of Formula 14-1
.05 g/m2 of the compound of Formula 14-2
.63 g/m2 of Gelatin
Inter/UV Absorber Layer
.04 g/m2 of Dioctyl hydroquinone 1.27 g/m2 of Gelatin
.39 g/m2 of the compound of Formula 14-4
Green Sensitive Layer
.28 g/m2 of Ag Interlayer with .75 g/m2 of Gelatin
.05 g/m2 of Dioctyl hydroquinone from Dispersion AA 1.51 g/m2 of Gelatin
Blue Sensitive Layer
1.08 g/m2 of the compound of Formula 14-5
.28 g/m2 of Ag Paper Support Paper Structure IV (Invention)

Protective Gel Layer with 1.07 g/m2 of Gelatin
.021 g/m2 of Dioctyl hydroquinone .27 g/m2 of the compound of Formula 14-1
.05 g/m2 of the compound of Formula 14-2
.63 g/m2 of Gelatin
UV Absorber Layer
.04 g/m2 of Dioctyl hydroquinone 1.09 g/m2 of Gelatin
Red Sensitive Layer
.42 g/m2 of the compound of Formula 14-3
.21 g/m2 of Ag .27 g/m2 of the compound of Formula 14-1
.05 g/m2 of the compound of Formula 14-2

-continued

.63 g/m2 of Gelatin
Inter/UV Absorber Layer
.04 g/m2 of Dioctyl hydroquinone 1.27 g/m2 of Gelatin
.39 g/m2 of the compound of Formula 14-4
Green Sensitive Layer
.28 g/m2 of Ag
Interlayer with .75 g/m2 of Gelatin
.05 g/m2 of Dioctyl hydroquinone from Dispersion AB 1.51 g/m2 of Gelatin
Blue Sensitive Layer
1.08 g/m2 of the compound of Formula 14-5
.28 g/m2 of Ag Paper Support As will be noted, the only difference between paper structures III and IV is that the interlayer in Structure III contains dioctyl hydroquinone coated from Dispersion AA while Structure IV contains dioctyl hydroquinone coated from Dispersion AB.

Papers of Structures III and IV were exposed to blue light and conventionally processed to develop all of the silver in the blue sensitive layer. The refection green status A density of the resulting yellow image was measured as a way to determine the level of interlayer color contamination present. The results are shown in the following table.

TABLE II

| Paper | Status A Green Density at Blue Sensitive Layer, Maximum Density |
|---|---|
| Structure III (prior art) | 0.440 |
| Structure IV (invention) | 0.422 |

These data show that an interlayer coated with the dioctyl hydroquinone containing Dispersion AB of this invention resulted in a purer, less orange yellow image.

EXAMPLE 16

The haze of paper (Structure V, below) prepared in accordance with the prior art was compared to paper (Structure VI, below) prepared in accordance with this invention.

Paper Structure V (Prior Art)

Protective Gel Layer with 1.07 g/m2 of Gelatin
.042 g/m2 of Dioctyl hydroquinone from Dispersion AA .16 g/m2 of the compound of Formula 14-1
.03 g/m2 of the compound of Formula 14-2
.49 g/m2 of Gelatin
UV Absorber Layer
.04 g/m2 of Dioctyl hydroquinone 1.09 g/m2 of Gelatin
Red Sensitive Layer
.42 g/m2 of the compound of Formula 14-3
.27 g/m2 of the compound of Structure 14-1
.21 g/m2 of Ag .16 g/m2 of the compound of Formula 14-1
.03 g/m2 of the compound of Formula 14-2
.49 g/m2 of Gelatin
Inter/UV Absorber Layer -continued .04 g/m2 of Dioctyl hydroquinone 1.27 g/m2 of Gelatin
.39 g/m2 of the compound of Formula 14-4
Green Sensitive Layer
.28 g/m2 of Ag Interlayer with .75 g/m2 of Gelatin
.09 g/m2 of Dioctyl hydroquinone 1.51 g/m2 of Gelatin
Blue Sensitive Layer
1.08 g/m2 of the compound of Formula 14-5
.28 g/m2 of Ag Paper Support Paper Structure VI (Invention)

Protective Gel Layer with 1.07 g/m2 of Gelatin
.042 g/m2 of Dioctyl hydroquinone from Dispersion AB .16 g/m2 of the compound of Formula 14-1
.03 g/m2 of the compound of Formula 14-2
.49 g/m2 of Gelatin
UV Absorber Layer
.04 g/m2 of Dioctyl hydroquinone 1.09 g/m2 of Gelatin
Red Sensitive Layer
.42 g/m2 of the compound of Formula 14-3
.27 g/m2 of the compound of Formula 14-1
.21 g/m2 of Ag .16 g/m2 of the compound of Formula 14-1
.03 g/m2 of the compound of Formula 14-2
.49 g/m2 of Gelatin
Inter/UV Absorber Layer
.04 g/m2 of Dioctyl hydroquinone 1.27 g/m2 of Gelatin
.39 g/m2 of the compound of Formula 14-4
Green Sensitive Layer
.28 g/m2 of Ag Interlayer with .75 g/m2 of Gelatin
.09 g/m2 of Dioctyl hydroquinone 1.51 g/m2 of Gelatin
Blue Sensitive Layer
1.08 g/m2 of the compound of Formula 14-5
.28 g/m2 of Ag Paper Support As will be noted, the only difference between paper structures V and VI is that the protective layer, in Structure V contains dioctyl hydroquinone coated from Dispersion AA while in Structure VI the corresponding layer contains dioctyl hydroquinone coated from Dispersion AB.

Papers of Structure V and VI were exposed with a white light exposure so that they both reached maximum density when processed in the conventional manner. Each sample was then processed. Each coating was measured using diffuse angle Status A densitometry. The results are given in the following table.

TABLE III

| | Status A Diffuse Densities at Maximum Density | | |
|---|---|---|---|
| Paper | Red | Green | Blue |
| Structure V (Prior Art) | 2.46 | 2.47 | 2.34 |

TABLE III-continued

| Paper | Status A Diffuse Densities at Maximum Density | | |
|---|---|---|---|
| | Red | Green | Blue |
| Structure VI (Invention) | 2.67 | 2.67 | 2.46 |

ADVANTAGES

With our invention, dispersions of photographically useful compounds (PUC) with relatively low molecular weights can be made with vastly improved stability to particle growth. Only small amounts of highly hydrophobic liquids or solids need to be added to the PUC. This insures that the utility of the PUC is not impaired.

The invention has been described in detail with particular reference to preferred embodiments thereof, but it is to be understood that variations and modifications can be effected within the spirit and scope of the invention.

What is claimed is:

1. A method for stabilizing a photographic dispersion comprising an aqueous medium and a dispersed liquid organic phase comprising a photographically useful compound which is (i) soluble in organic solvents, (ii) substantially insoluble in water, and (iii) subject to particle growth of at least 10% of its initial particle size when maintained in said dispersion, which method comprises adding to said dispersed phase, a hydrophobic, photographically inert compound which has a $\log P_{(calc)}$ greater than 9 and does not solidify or gel the dispersed phase, said photographically inert compound being added in an amount sufficient to inhibit particle growth of said photographically useful compound in said dispersion, wherein said amount is from 1 to 10% by weight, based upon the weight of the photographically useful compound.

2. A method according to claim 1, wherein the photographically inert compound is added in an amount about 0.01% to about 90% by weight, based on the weight of the photographically useful compound.

3. A method according to claim 1, wherein the photographically useful compound is dibutyl phthalate; dipentyl phthalate; bis(2-ethylhexyl) sulfoxide; tricresyl phosphate; dioctyl hydroquinone; anisylidene-n-propylcyanoacetate; 3-N,N-di-n-hexylaminoallylidene malononitrile; or butanamide, N-(4-((((4-cyanophenyl)amino)carbonyl)amino)-3-hydroxyphenyl)-2-(dodecylsulfonyl)- 3-methyl.

4. A method according to claim 1, wherein the photographically inert compound is selected from the group consisting of:

(I) alkanes, alkenes, and alkyl halides;

(II) compounds which are liquids or oil soluble solids and have an elemental composition consisting of carbon, hydrogen and oxygen;

(III) esters and amides of sulfur or phosphorus acids; and (IV) amides and amines.

5. A method according to claim 4, wherein photographically inert compound is a phthalate, a substituted phenol or a phosphate.

6. A method according to claim 1, wherein the photographically inert compound is selected from the group consisting of: hexadecane, bis(2-ethylhexyl) azelate, tri(2-ethylhexyl) phosphate, trioctylphosphine oxide, dinonyl phthalate, didecyl phthalate, didodecyl phthalate, 3-(4-hydroxy-3,5-di-t-butylphenyl)-propionic acid, octadecyl ester, and trioctyl amine.

7. A method according to claim 6, wherein photographically inert compound is dinonyl phthalate, didecyl phthalate or didodecyl phthalate.

8. A method according to claim 6, wherein the photographically inert compound is 3-(4-hydroxy-3,5-di-t-butylphenyl)-propionic acid, octadecyl ester.

9. A method according to claim 6, wherein the photographically inert compound is tri(2-ethylhexyl) phosphate.

10. A photographic dispersion comprising an aqueous medium and a dispersed liquid organic phase comprising:

(a) a photographically useful compound which is (i) soluble in organic solvents, (ii) substantially insoluble in water, and (iii) subject to particle growth of at least 10% of its initial particle size when maintained in said dispersion; and (b) in an amount sufficient to inhibit particle growth of said photographically useful compound, a hydrophobic, photographically inert compound which has a $\log P_{(calc)}$ greater than 9 and which does not solidify or gel the dispersed phase, wherein said amount is from 1 to 10% by weight, based upon the weight of the photographically useful compound.

11. A photographic dispersion according to claim 10, wherein (b) is present in an amount about 0.01% to about by weight, based on the weight of (a).

12. A photographic dispersion according to claim 10, wherein (a) is dibutyl phthalate,dipentyl phthalate, bis(2-ethylhexyl) sulfoxide, tricresyl phosphate, dioctyl hydroquinone, anisylidene-n-propylcyanoacetate, or 3-di-n-hexylaminoallylidene malononitrile.

13. A photographic dispersion according to claim 10 where in (b) is selected from the group consisting of:

(I) alkanes, alkenes, and alkyl halides;

(II) compounds which are liquids or oil soluble solids and have an elemental composition consisting of carbon, hydrogen and oxygen;

(III) esters and amides of sulfur or phosphorus acids; and (IV) amides and amines.

14. A photographic dispersion according to claim 13, wherein (b) is a phthalate, a substituted phenol or a phosphate.

15. A photographic dispersion according to claim 10, wherein (b) is selected from the group consisting of:

hexadecane, bis(2-ethylhexyl) azelate, tri(2-ethylhexyl) phosphate, trioctylphosphine oxide, dinonyl phthalate, didecyl phthalate, didodecyl phthalate, 3-(4-hydroxyphenyl-3,5-di-t-butyl)-propionic acid, octadecyl ester, and trioctyl amine.

16. A photographic dispersion according to claim 15, wherein (b) is dinonyl phthalate, didecyl phthalate or didodecyl phthalate.

17. A photographic dispersion according to claim 15, wherein (b) is 3-(4-hydroxyphenyl-3,5-di-t-butyl)propionic acid, octadecyl ester.

18. A photographic dispersion according to claim 15, wherein (b) is tri(2-ethylhexyl) phosphate.

19. A photographic element comprising a support having coated thereon a layer prepared from a dispersion according to claim 10.

20. A photographic element according to claim 19, wherein the aqueous medium of the dispersion contains silver halide particles.

21. A photographic element according to claim 19, wherein the photographic element comprises at least one layer prepared from a dispersion according to claim 10 and at least one layer comprising an emulsion of silver halide particles.

22. A photographic element according to claim 19, wherein the support comprises paper.

23. A photographic element according to claim 19, wherein the support comprises film.

24. A method of improving haze in a multilayer color photographic paper which comprises providing the paper with an protective overcoat layer comprising a dispersion of claim 10.

25. A method according to claim 24, wherein the dispersion contains as the photographically useful compound, dioctyl hydroquinone.

26. A method for stabilizing a photographic dispersion comprising an aqueous medium and a dispersed liquid organic phase comprising a photographically useful compound which is (i) soluble in organic solvents, (ii) substantially insoluble in water, and (iii) subject to particle growth of at least 10% of its initial particle size when maintained in said dispersion, which method comprises adding to said dispersed phase, a hydrophobic, photographically inert compound which has a $\log P_{(calc)}$ greater than 9 and does not solidify or gel the dispersed phase, said photographically inert compound being added in an amount sufficient to inhibit particle growth of said photographically useful compound in said dispersion, wherein the photographically useful compound is dibutyl phthalate; dipentyl phthalate; bis(2-ethylhexyl) sulfoxide; tricresyl phosphate; dioctyl hydroquinone; anisylidene-n-propylcyanoacetate; 3-N,N-di-n-hexylaminoallylidene malononitrile; or butanamide, N-(4-(((( 4-cyanophenyl)amino)carbonyl)amino)-3-hydroxyphenyl)- 2-(dodecylsulfonyl)-3-methyl.

27. A photographic dispersion comprising an aqueous medium and a dispersed liquid organic phase comprising: (a) a photographically useful compound which is (i) soluble in organic solvents, (ii) substantially insoluble in water, and (iii) subject to particle growth of at least 10% of its initial particle size when maintained in said dispersion, wherein said photographically useful compound is dibutyl phthalate, dipentyl phthalate, bis(2-ethylhexyl) sulfoxide, tricresyl phosphate, dioctyl hydroquinone, anisylidene-n-propylcyanoacetate, or 3-di-n-hexylaminoallylidene malononitrile; and (b) in an amount sufficient to inhibit particle growth of said photographically useful compound, a hydrophobic, photographically inert compound which has a $\log P_{(calc)}$ greater than 9 and which does not solidify or gel the dispersed phase.

28. A method of improving haze in a multilayer color photographic paper which comprises providing the paper with a protective overcoat layer comprising a dispersion comprising an aqueous medium and a dispersed liquid organic phase comprising: (a) a photographically useful compound which is (i) soluble in organic solvents, (ii) substantially insoluble in water, and (iii) subject to particle growth of at least 10% of its initial particle size when maintained in said dispersion; and (b) in an amount sufficient to inhibit particle growth of said photographically useful compound, a hydrophobic, photographically inert compound which has a $\log P_{(calc)}$ greater than 9 and which does not solidify or gel the dispersed phase.

* * * * *

UNITED STATES PATENT AND TRADEMARK OFFICE

CERTIFICATE OF CORRECTION

PATENT NO. : 5,468,604

DATED : Nov. 21, 1995

INVENTOR(S) : Paul L. Zengerle, et al

It is certified that error appears in the above-indentified patent and that said Letters Patent is hereby corrected as shown below:

column 21, line 39, change "claim 1" to --claim 26--.

column 22, line 32, change "claim 10" to --claim 27--.

column 22, line 33, after 0.01% to about" insert --90%--.

Signed and Sealed this

Twenty-third Day of July, 1996

Bruce Lehman

*Attest:*

BRUCE LEHMAN

*Attesting Officer*

*Commissioner of Patents and Trademarks*